US011819168B2

(12) United States Patent
Berton

(10) Patent No.: US 11,819,168 B2
(45) Date of Patent: Nov. 21, 2023

(54) PORTABLE SINK

(71) Applicant: Melanie Berton, Treviso (IT)

(72) Inventor: Melanie Berton, Treviso (IT)

( * ) Notice: Subject to any disclaimer, the term of this patent is extended or adjusted under 35 U.S.C. 154(b) by 83 days.

(21) Appl. No.: 17/608,577

(22) PCT Filed: Apr. 3, 2020

(86) PCT No.: PCT/EP2020/059624
§ 371 (c)(1),
(2) Date: Nov. 3, 2021

(87) PCT Pub. No.: WO2020/224892
PCT Pub. Date: Nov. 12, 2020

(65) Prior Publication Data

US 2022/0233026 A1 Jul. 28, 2022

(30) Foreign Application Priority Data

May 3, 2019 (IT) ..... 102019000006502

(51) Int. Cl.
*A47K 1/02* (2006.01)
*A45D 19/04* (2006.01)
*A47K 1/12* (2006.01)

(52) U.S. Cl.
CPC ..... *A47K 1/02* (2013.01); *A45D 19/04* (2013.01); *A47K 1/12* (2013.01)

(58) Field of Classification Search
CPC ..... A47K 1/02; A47K 1/12; A45D 19/04
USPC ..... 4/625–627, 641, 643–648, 650, 653
See application file for complete search history.

(56) References Cited

U.S. PATENT DOCUMENTS

2003/0234265 A1 12/2003 Peck
2004/0148697 A1* 8/2004 Patterson ..... A47K 1/02 4/619

FOREIGN PATENT DOCUMENTS

| | | | | |
|---|---|---|---|---|
| CN | 109106251 A | 1/2019 | | |
| FR | 1133593 A | 3/1957 | | |
| GB | 402898 A | 12/1933 | | |
| NL | 1017273 C1 | 3/2001 | | |
| WO | WO-9739647 A1 * | 10/1997 | ..... | A47K 1/02 |

OTHER PUBLICATIONS

International Search Report dated May 13, 2020 re: Application No. PCT/EP2020/059624, pp. 1-3, citing: GB 42 898 A, NL 1 017 273 C1, CN 109 106 251 A, US 2003/0234265 A1 and FR 1 133 593 A.
IT Search Report dated Jan. 14, 2020 re: Application No. IT 201900006502, pp. 1-8, citing: GB 42 898 A, NL 1 017 273 C1, CN 109 106 251 A, US 2003/0234265 A1 and FR 1 133 593 A.

* cited by examiner

*Primary Examiner* — Tuan N Nguyen
(74) *Attorney, Agent, or Firm* — CANTOR COLBURN LLP

(57) ABSTRACT

A portable sink having a frame, provided with at least one pair of wheels and having a vertical post, which is adjustable in height. A reservoir is detachably associable with the post and is provided with a substantially box-like central body from which a conical base protrudes downward, and with the lower end of which a flexible hose is associated. A plate is associated stably, below the reservoir, to with the vertical post and a folding support is associated to with the plate for the temporary insertion of a bowl for collecting the drain of an overlying basin. The plate has a second temporary engagement component for the collection bowl and the basin.

10 Claims, 7 Drawing Sheets

PORTABLE SINK

TECHNICAL FIELD

The present disclosure relates to a portable sink that can be easily moved and transported from one place to another and does not need a fixed installation and therefore can be used in any place.

BACKGROUND

Currently, it is known that persons who are bedridden because of particular pathologies, surgical procedures or motor skill deficits are unable to take care of their own hygiene in an autonomous manner.

These bedridden persons, in order to meet their hygiene needs, need a person who brings a bowl that is rested on the bed and a jug that is held by another person who pours the contents thereof in the bowl to allow the bedridden persons to wash for example their hands and take care of other hygiene needs.

One drawback that is found in the background art resides first of all in that the bedridden person constantly needs help from another person during all the hygiene operations.

This background art furthermore requires the other person to empty the bowl and fill the jug several times because of the limited volume of water that can be contained in the jug and in the bowl, having then to move the bowl closer and support it near the bedridden person if the latter needs for example to wash their face, so as to prevent the water from wetting the bed.

If, in order to avoid the continuous emptying of the bowl and the continuous filling of the jug, the bedridden person reuses the water contained in the bowl, this dirty and stagnant water would carry bacteria, with a consequent negative effect on hygiene care.

SUMMARY

The aim of the present disclosure is to eliminate the drawbacks mentioned above, by providing a sink that allows bedridden people to take care personally, in an autonomous, convenient and quick manner, of their own hygiene.

Within this aim, the present disclosure provides a sink that allows hygiene care of the bedridden person in a condition of maximum hygiene.

The disclosure provides a sink that, when used, has a small bulk.

The disclosure further provides a sink that can be easily moved and transported from one place to another and does not need a fixed installation.

The disclosure also provides a sink that is structurally simple, has low production costs and can be manufactured with ordinary known systems.

This aim and these and other advantages that will become better apparent hereinafter are achieved by providing a portable sink, characterized in that the sink comprises a frame, provided with at least one pair of wheels and comprising a vertical post, which is adjustable in height and with which a reservoir is detachably associated, said reservoir is provided with a substantially box-like central body from which a conical base protrudes downward, a flexible hose being associated with the lower end of said base, a plate being associated stably, below said reservoir, with said vertical post, a folding support being associated with said plate for the temporary insertion of a bowl, such that the bowl is removable, for collecting the drain of an overlying basin, said plate having a second temporary engagement means for said collection bowl and said basin.

BRIEF DESCRIPTION OF THE DRAWINGS

Further characteristics and advantages of the disclosure will become better apparent from the detailed description of a particular but not exclusive embodiment, illustrated by way of non-limiting example in the accompanying drawings, wherein.

DETAILED DESCRIPTION OF THE DRAWINGS

Figure 1:
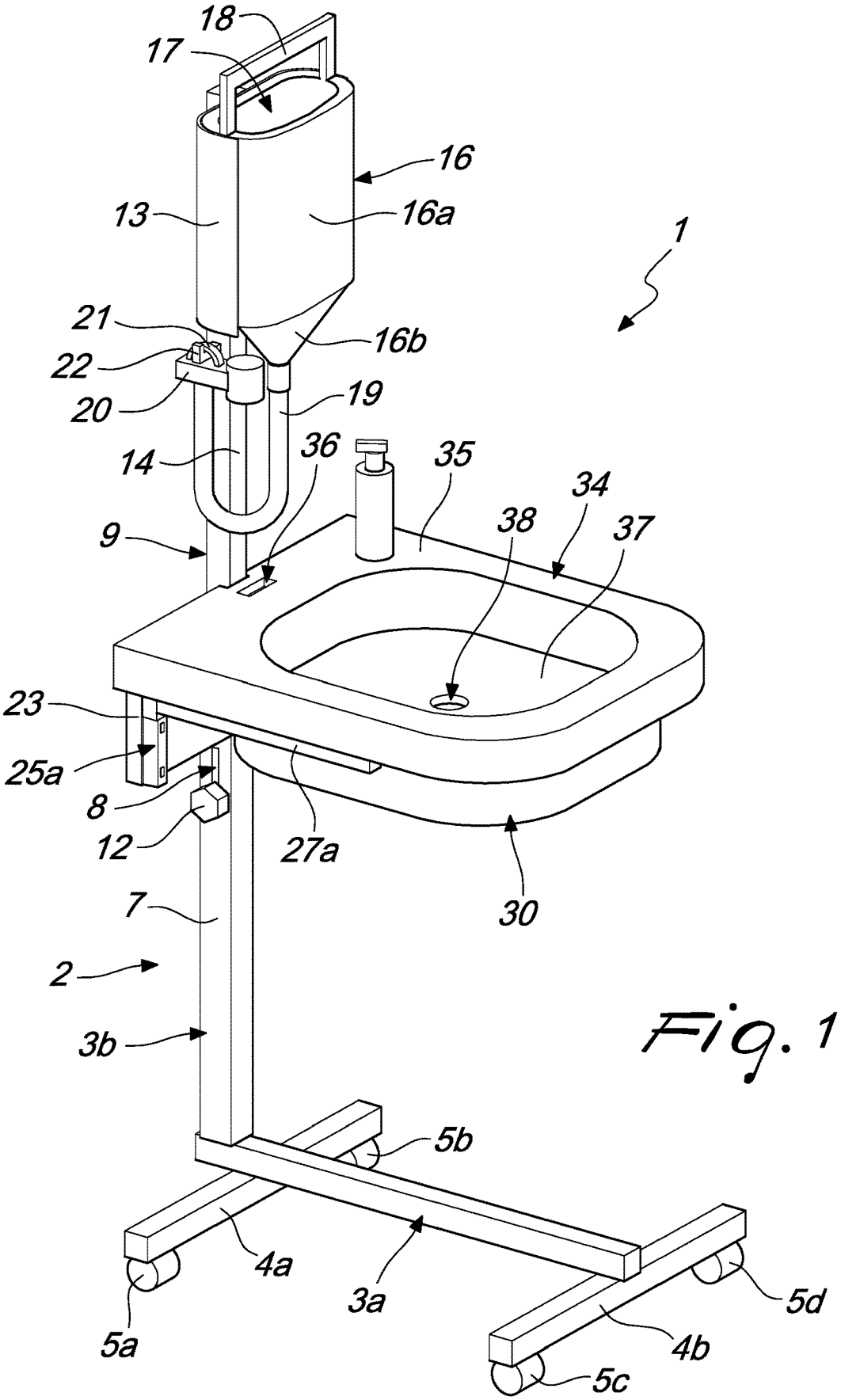
FIG. 1 is a lateral perspective view of the disclosure.
Figure 2:
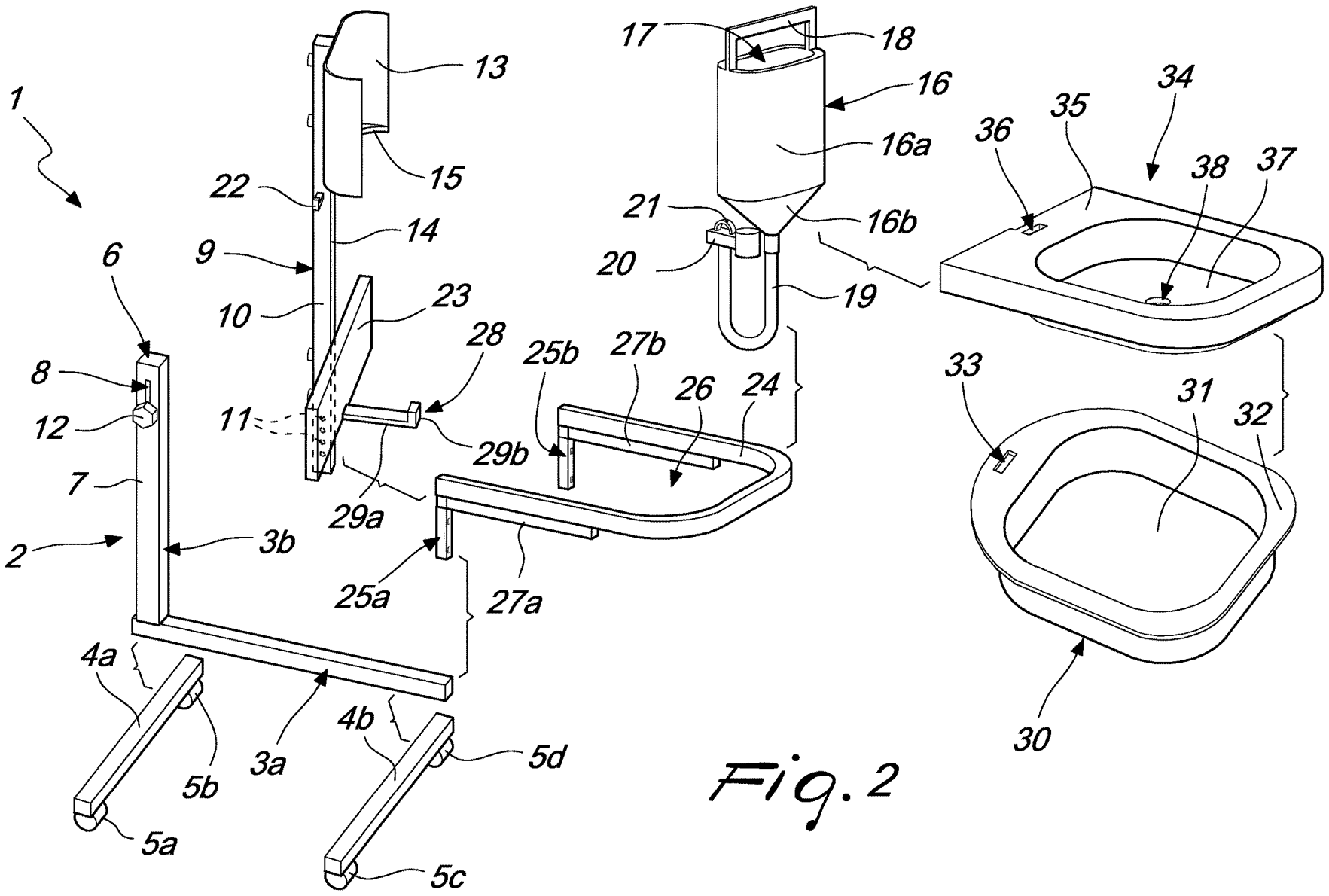
FIG. 2 is an exploded view of the disclosure.
Figure 4:
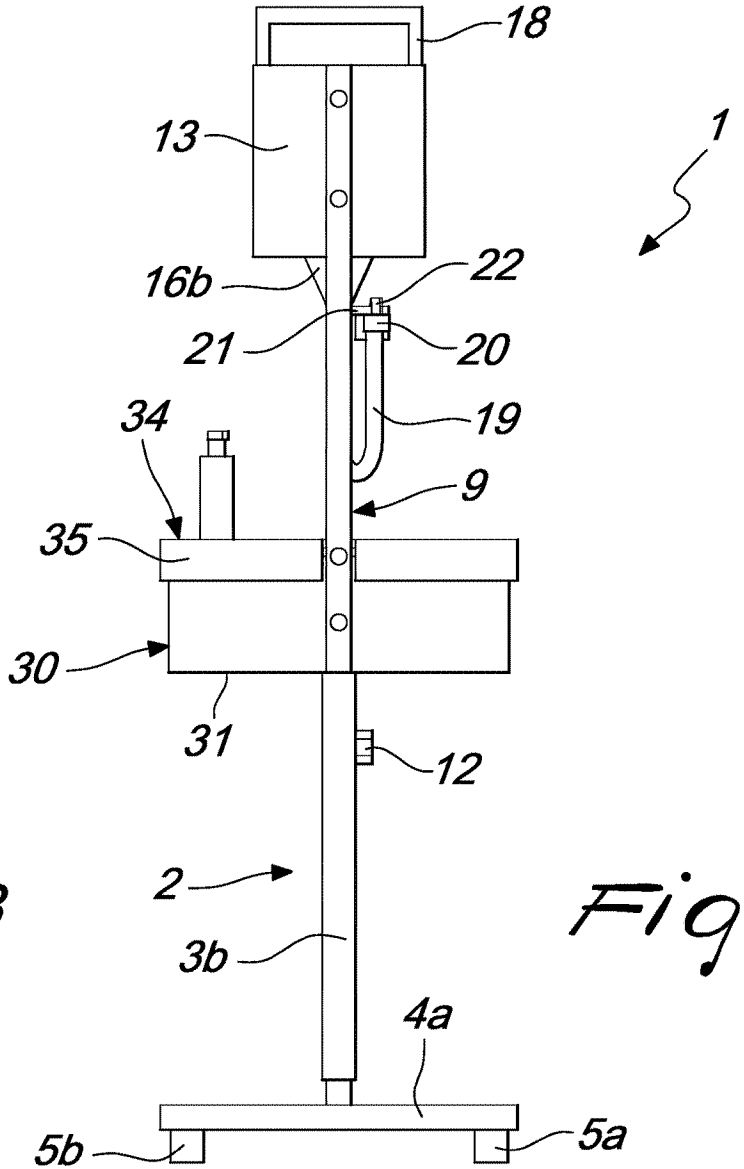
FIG. 4 is a rear view of the disclosure.
Figure 3:
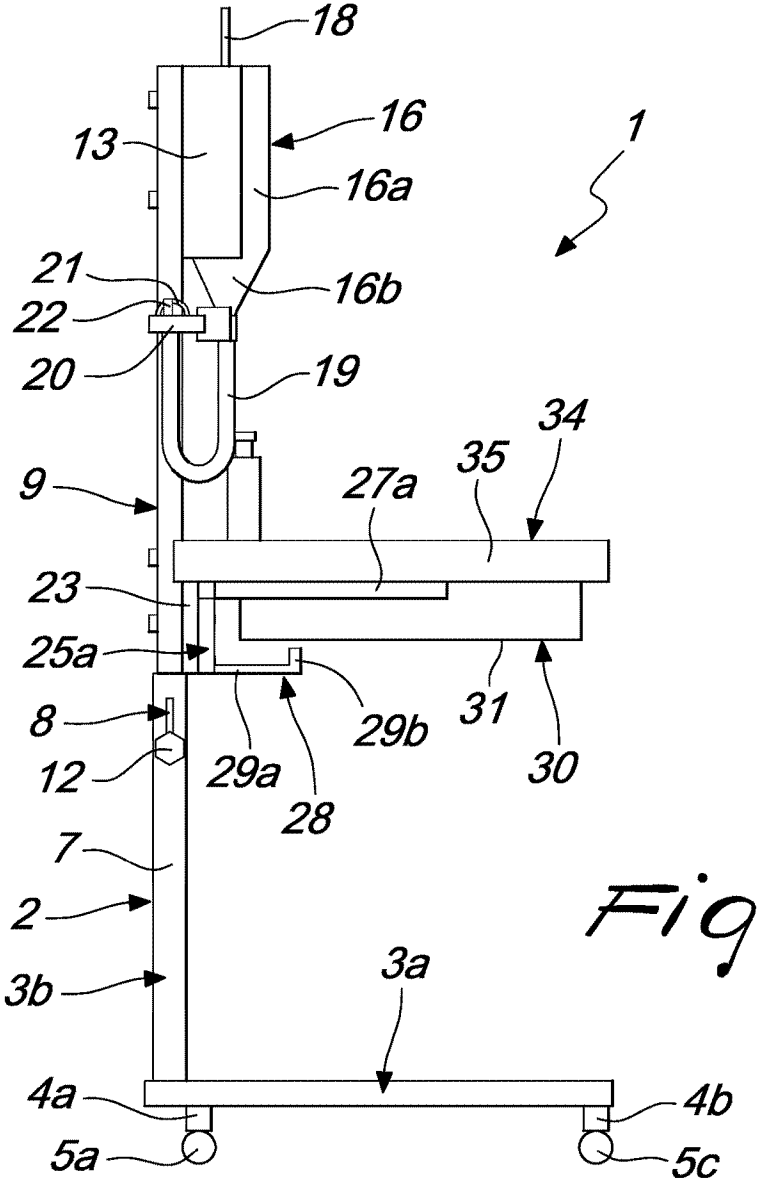
FIG. 3 is a side view of the disclosure.
Figure 5:
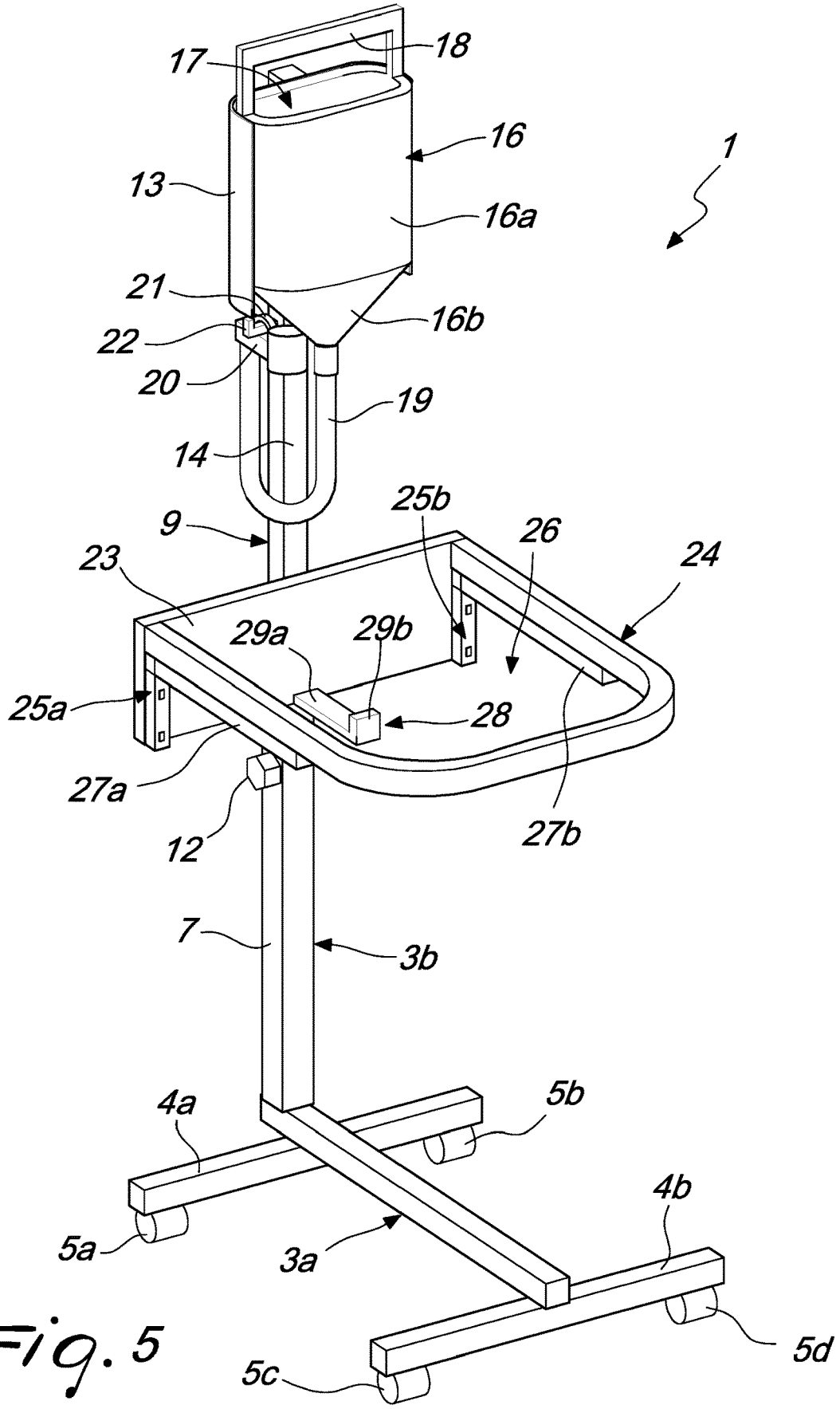
FIG. 5 is a lateral perspective view of the disclosure without the collection bowl and the basin.
Figure 7:
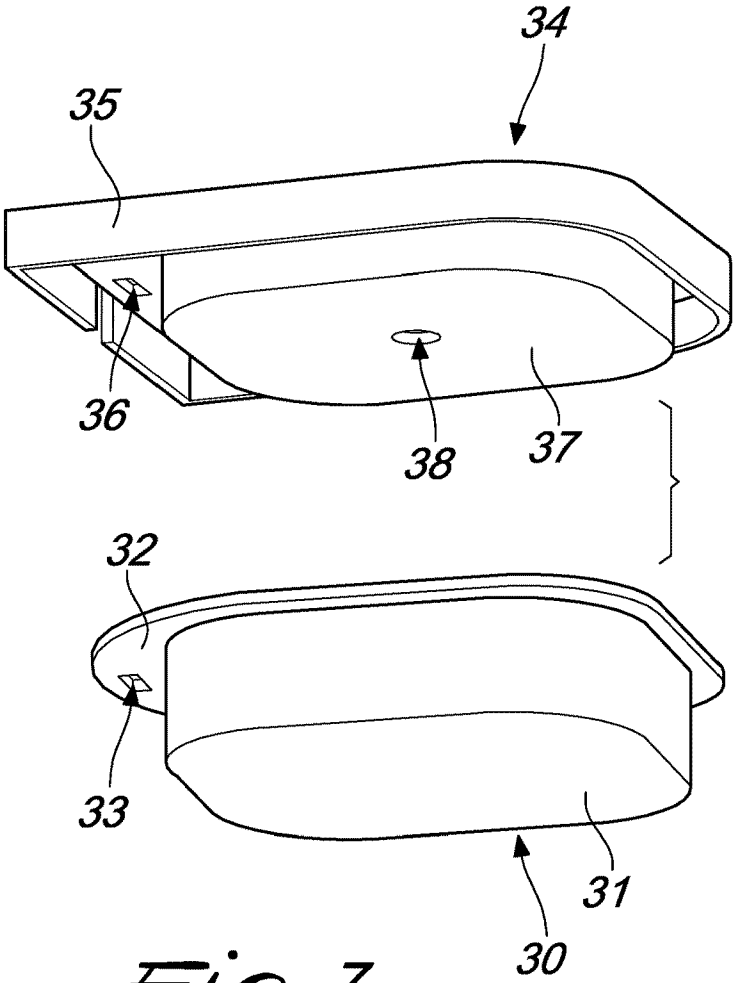
FIG. 7 is a lateral perspective view from below of the collection bowl and of the basin.
Figure 6:
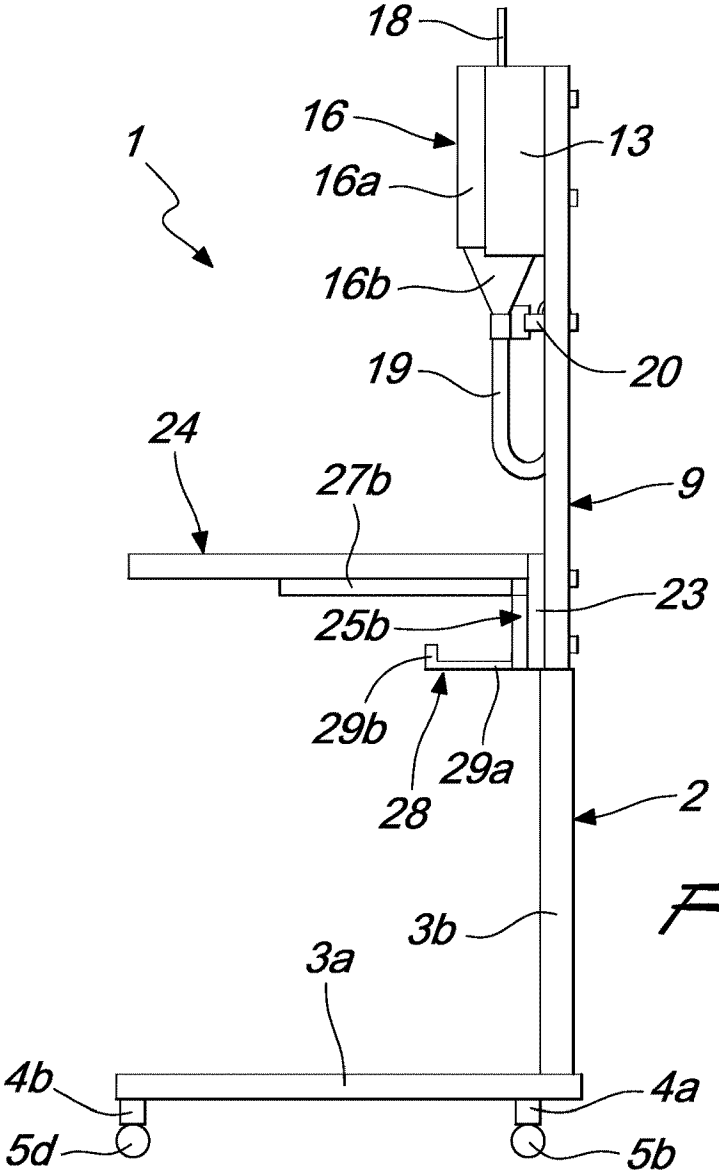
FIG. 6 is a side view of the disclosure of FIG. 5.
Figure 9:
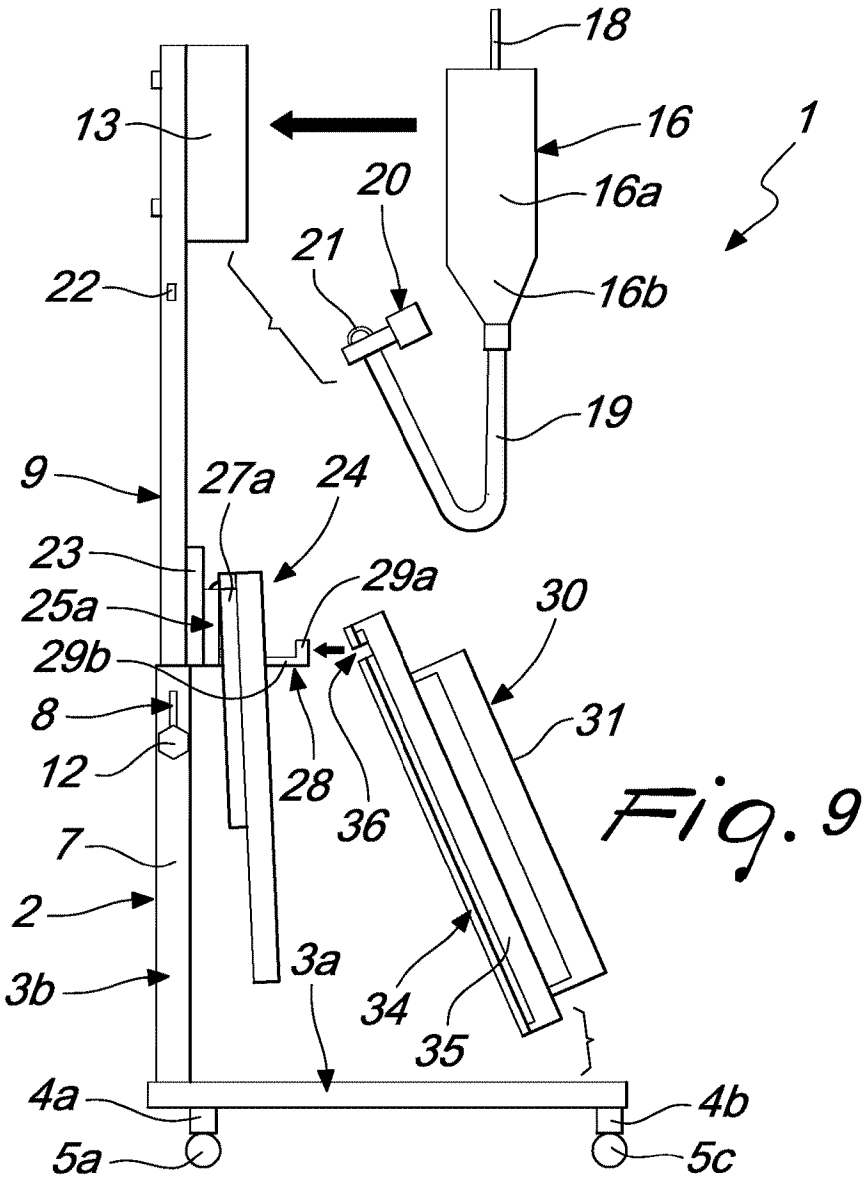
FIG. 9 is a side view of the disclosure in which the folding support is completely folded.
Figure 8:
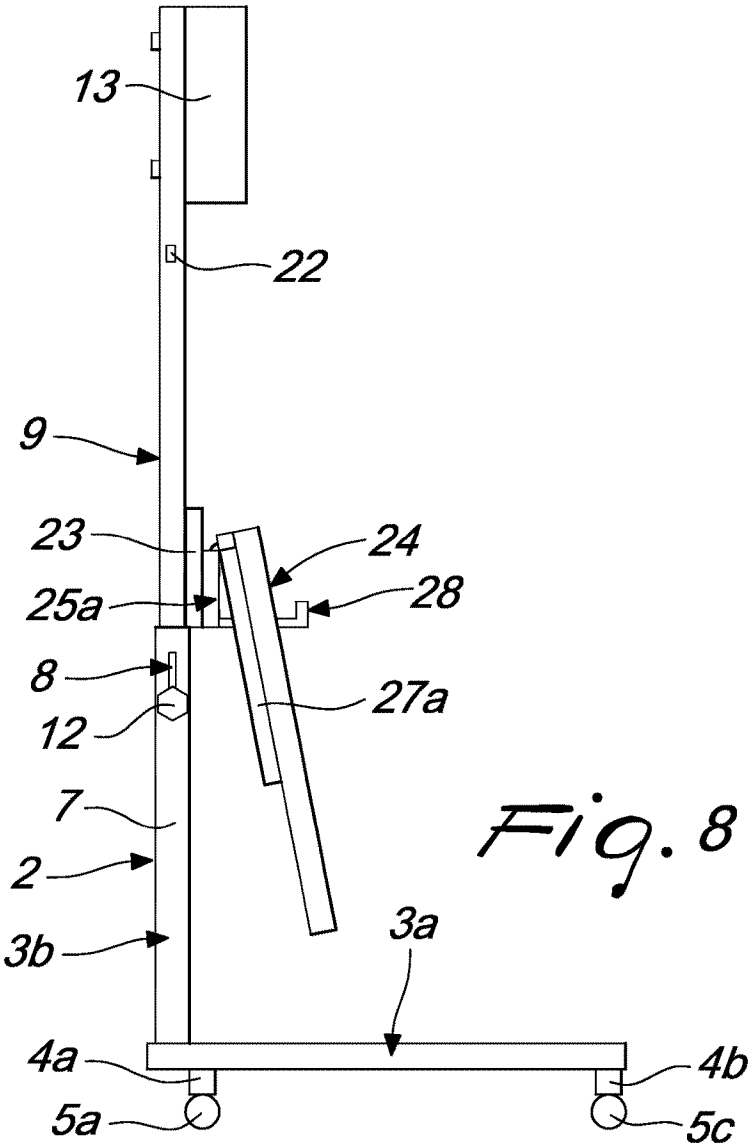
FIG. 8 is a side view of the disclosure without the reservoir, the collection bowl and the basin, in which the folding support is partially folded.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to the above figures, the reference numeral 1 designates a portable sink, which comprises a frame 2 that is substantially L-shaped and comprises a first horizontal arm 3*a* and a second vertical arm 3*b*.

In the embodiment shown in FIGS. 1 to 10, two mutually parallel distinct arms 4*a*, 4*b* are stably connected to the first horizontal arm 3*a* of the frame 2, each of said arms 4*a*, 4*b* being provided in a lower region on each end with a wheel 5*a*, 5*b*, 5*c*, 5*d*.

Advantageously, each one of said wheels 5*a*, 5*b*, 5*c*, 5*d* can be of the self-locking type in order to keep the portable sink 1 stationary in position when in use.

The vertical arm 3*b* is axially hollow so as to form internally a seat 6.

A slot 8 is defined on the first lateral surface 7 of the vertical arm 3*b*, proximate to the upper end thereof.

The frame 2 comprises a vertical post 9, which is associable telescopically and slidingly inside the seat 6 of the vertical arm 3*b* of said frame 2.

The vertical post 9 has, at a second lateral surface 10, which during use is aligned with said first lateral surface 7 of the vertical arm 3*b*, a plurality of holes 11 which are threaded and aligned along a same vertical axis.

The frame 2 comprises a knob 12 which is provided with a threaded stem which acts in the slot 8 provided in the vertical arm 3*b* of the frame 2 and can be fastened at one of the holes 11 defined in said vertical post 9, in order to lock the vertical post 9 at the desired height.

The vertical post 9 is thus adjustable in height.

An arc-like partition 13 is associated with the vertical post 9 at the free upper end, is stably associated at the first front surface 14 thereof, and is provided in a lower region with a tab 15 that protrudes on the opposite side with respect to said front surface 14.

The portable sink 1 comprises a reservoir 16 having a substantially box-like central body 16*a* shaped complementarily to the arc-like surface of said partition 13, from which a conical base 16*b* protrudes downward.

The central body 16*a* is provided in an upper region with an opening 17.

The partition 13 and the tab 15 are adapted to allow to associate temporarily the reservoir 16 with the vertical post 9, the central body 16*a* resting temporarily on the tab 15.

The reservoir 16 is made of non-toxic material and has preferably a capacity of three liters.

The reservoir 16 is provided in an upper region with a handle 18, in order to facilitate its transport, which is substantially C-shaped and surmounts said opening 17.

A flexible hose 19 is associated with the lower end of the conical base 16*b* of the reservoir 16.

The flexible hose 19 has, at the end that is opposite the conical base 16*b*, a spray head 20 provided with a button 21 to allow the controlled dispensing of the liquid contained in the reservoir 16.

The vertical post 9 is provided with a first engagement means 22 for the spray head 20.

In the embodiment shown in FIGS. 1 to 10, the first engagement means 22 is positioned at the second lateral surface 10 of the vertical post 9 in a region below the partition 13.

The portable sink 1 comprises a plate 23 with a substantially rectangular base, which is stably associated with the first front surface 14 of the vertical post 9, below the partition 13.

A folding support 24 is frontally associated with the plate 23 and thus protrudes frontally from said plate 23 and has a substantially tubular curved shape so as to form a second opening 26.

Advantageously, two reinforcement members 27*a*, 27*b* are present below the folding support 24 and means 25*a*, 25*b* adapted to allow the rotation of said folding support 24 are associated with the end of said members that is adjacent to the plate 23.

A second temporary engagement means 28 is associated frontally with the plate 23 and is substantially L-shaped.

The second temporary engagement means 28 is constituted by a first wing 29*a* that protrudes frontally to the plate 23 and by a second wing 29*b* which protrudes at right angles to the first wing 29*a* in the direction of the folding support 24 and is directed upward.

The portable sink 1 comprises a collection bowl 30 which is provided with a first bottom 31 and with a first perimetric ridge 32 on which a first hole 33 is defined which has such dimensions as to allow it to be inserted inside said second temporary engagement means 28.

The collection bowl 30 has an overall height that is lower than the space between the folding support 24 and the free end of the second wing 29*b* of the second temporary engagement means 28.

The first bottom 31 of the collection bowl 30 has a length that is smaller than the height of the second arm 3*b* of the frame 2.

The collection bowl 30 is made of non-toxic material.

When the portable sink 1 is in use, the collection bowl 30 is adapted to be inserted temporarily at the second opening 26 of the folding support 24 and the first perimetric ridge 32 is adapted to rest temporarily on the folding support 24.

When the portable sink 1 is not in use, the collection bowl 30 is adapted to be engaged with said second temporary engagement means 28.

The portable sink 1 comprises a basin 34 which is provided with a second perimetric ridge 35, which is substantially C-shaped and in which a second hole 36 is defined which has the same shape as the first hole 33 of the collection bowl 30 and is provided with a second bottom 37 provided with a drain hole 38.

The basin 34 is adapted to be superimposed on the collection bowl 30 and has a height that is smaller than the height of the collection bowl 30, so that the second bottom 37 is not in contact with the first bottom 32 of the collection bowl 30.

The basin 34 has a length that is slightly greater than the length of the collection bowl 30 and smaller than the height of the second arm 3*b* of the frame 2.

The basin 34 is made of non-toxic material.

It has thus been found that the disclosure achieves the intended aim and objects, an disclosure having been obtained which allows bedridden people to take care personally, in an autonomous, convenient and quick manner, of their own hygiene.

In fact, the portable sink 1 is easily brought close by or to the bedridden person by means of the wheels 5*a*, 5*b*, 5*c*, 5*d*, adjusting beforehand the height of the collection bowl 30 and of the basin 34 by means of the telescopic height adjustment of the post 9; the position can then be locked by virtue of the self-locking wheels.

Thus, the bedridden person is then capable of providing personally to their own hygiene by actuating the spray head 20 with the button 21 that allows the controlled dispensing of the liquid contained in the reservoir 16 that is collected into the collection bowl 30.

The portable sink 1 dispenses a quantity of water which is sufficient to ensure the hygiene care of the patient by virtue of the capacity of the reservoir 16.

It has been found, furthermore, that the disclosure allows hygiene care of the bedridden person in a condition of maximum hygiene by virtue of the fact that the reservoir 16, the collection bowl 30 and the basin 34 are made of non-toxic material, are easy to be washed and prevent the formation of bacteria in the clean water that is used for the care of the bedridden person.

In particular, the cone-like shape of the conical base 16*b* that protrudes below the central body 16*a* of the reservoir 16 avoids the stagnation and therefore the formation of bacteria in the reservoir 16.

Furthermore, the overlapping of the basin 34 on the collection bowl 30 of the drain of said basin 34 through the drain hole 38 allows to collect and separate the used water from the dispensed clean water, thus preventing the dirty and stagnant water from coming into contact with the dispensed clean water.

Finally, the reservoir 16, the collection bowl 30 and the basin 34 can be cleaned easily because they are all components that can be easily uncoupled respectively from the partition 13 and from the folding support 24; furthermore, the large upper opening 17 of the reservoir 16 allows easy cleaning thereof.

Figure 10:
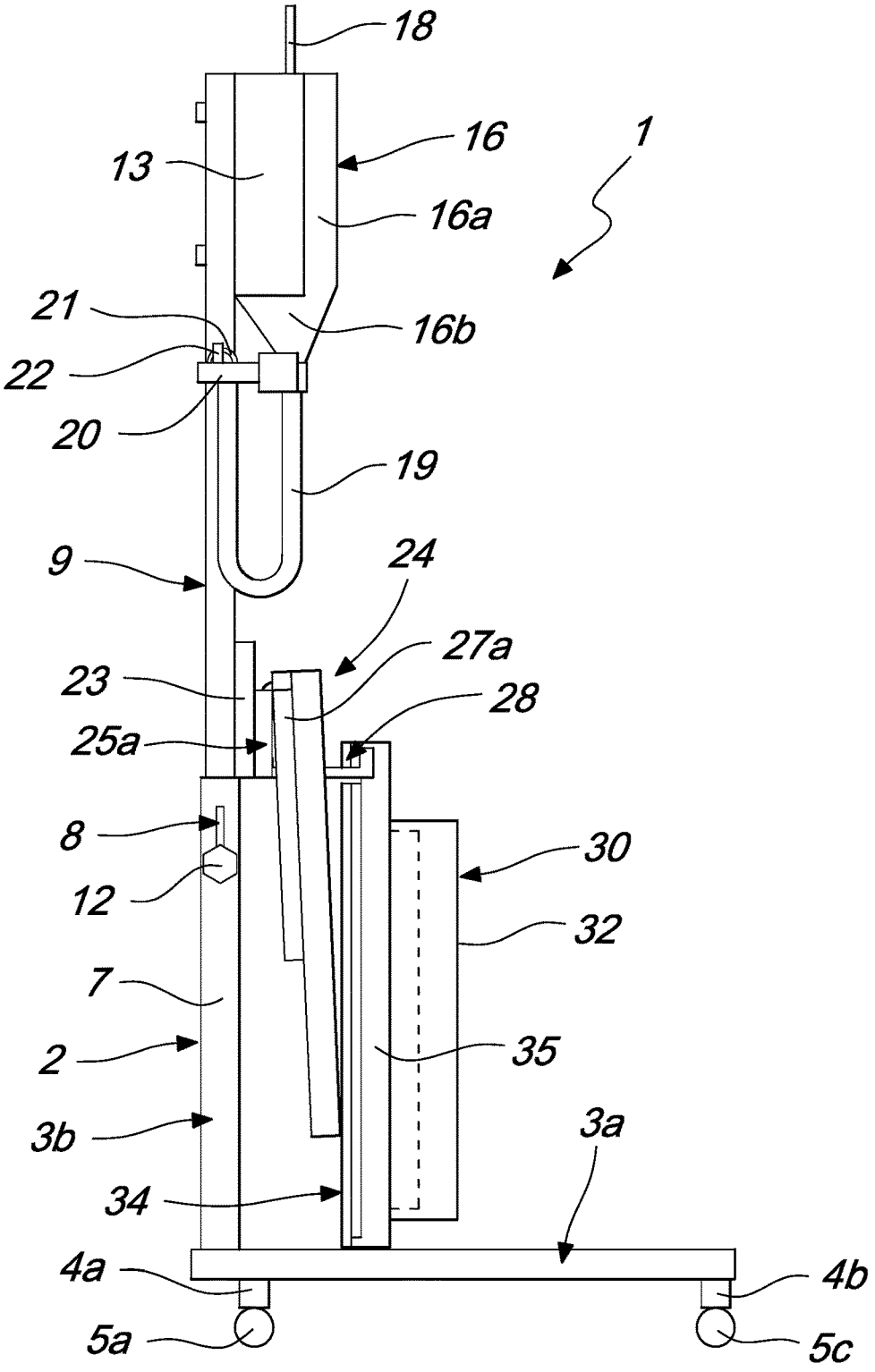
FIG. 10 is a side view of the disclosure in the non-use condition.

Moreover, it is noted that the disclosure, when not in use, is compact, as shown in FIG. 10, since the vertical post 9 can be adjusted at its minimum height by virtue of the knob 12, the folding support 24 can be folded at 90° so as to be arranged along an axis that is parallel to the vertical post 9, and the collection bowl 30 and the basin 34 can be engaged to the second temporary engagement means 28 by means of the first and second holes 33, 36.

Moreover, it is possible to engage a plurality of collection bowls 30 with superimposed basins 34 to the second temporary engagement means 28, providing an embodiment of the portable sink 1, not shown, in which the first wing 29*a* of the second temporary engagement means 28 is as long as the first arm 3*a* of the frame 2.

Finally, it has been found that the disclosure can be easily moved and transported from one place to another and does not require a fixed installation.

The disclosure is of course susceptible of numerous modifications and variations, all of which are within the scope of the appended claims.

The materials used, as well as the dimensions that constitute the individual components of the disclosure, may of course be more pertinent according to the specific requirements.

The characteristics indicated as advantageous, convenient or the like may also be omitted or be replaced with equivalents.

The disclosures in Italian Patent Application No. 102019000006502 from which this application claims priority are incorporated herein by reference.

The invention claimed is:

1. A portable sink comprising:

a frame having at least one pair of wheels;

a vertical post movably coupled to the frame, said vertical post is adjustable in height relative to the frame;

a reservoir configured to be detachably associated with the vertical post, said reservoir provided with a central body from which a conical base protrudes downward;

a flexible hose associated with a lower end of said conical base;

a plate associated stably with said vertical post and positioned below said reservoir; and a folding support associated with said plate for a removable collection bowl for collecting a drain of an overlying basin, said plate having a second removable engagement means for said collection bowl and said basin.

2. The portable sink according to claim 1, wherein said frame is substantially L-shaped and comprises a first horizontal arm and a second vertical arm, said second vertical arm is axially hollow so as to form internally a seat wherein said vertical post is associable telescopically and slidingly in said seat, wherein a slot is provided on a first lateral surface of said vertical arm, proximate to an upper end thereof, said vertical post having, at a second lateral surface, which during use is aligned with said first lateral surface of said vertical arm, a plurality of holes that are threaded and aligned along a same vertical axis, said frame comprising a knob provided with a threaded stem that acts in said slot provided in said vertical arm and is configured to be fastened at one of said holes, configured to lock said vertical post at a desired height.

3. The portable sink according to claim 1, wherein an arc-shaped partition is associated with said vertical post at a free upper end, is stably associated at a first front surface thereof, and is provided in a lower region with a tab that protrudes on an opposite side with respect to said front surface, said central body of said reservoir is shaped complementarily to an arc-shaped surface of said partition configured to associate temporarily said reservoir with said vertical post, said central body resting temporarily on said tab.

4. The portable sink according to claim 1, wherein said central body of said reservoir is provided in an upper region with an opening and wherein said reservoir is provided in an upper region with a handle, configured to facilitate transport thereof, said handle is substantially C-shaped and surmounting said opening, said reservoir is made of non-toxic material.

5. The portable sink according to claim 1, wherein said flexible hose has, at an end that is opposite said conical base, a spray head provided with a button to allow a controlled dispensing of liquid contained in said reservoir, said vertical post is provided with first engagement means for said spray head.

6. The portable sink according to claim 1, wherein said folding support is associated with and protrudes frontally from said plate and has a substantially tubular curved shape so as to form a second opening, two reinforcement members are present below said folding support, means adapted to allow a rotation of said folding support is associated with an end of said members that is adjacent to said plate.

7. The portable sink according to claim 1, wherein said second removable engagement means is associated with and protrudes frontally from said plate and is substantially L-shaped to form a first wing that protrudes frontally to said plate and a second wing that protrudes at right angles to said first wing in a direction of said folding support and is directed upward.

8. The portable sink according to claim 1, wherein said collection bowl is provided with a first bottom and with a first perimetric ridge on which a first hole is defined having dimensions as to allow said collection bowl to be inserted in said second removable engagement means, said collection bowl having an overall height that is smaller than a space between said folding support and a free end of said second wing of said second removable engagement means, said first bottom having a length that is smaller than a height of said second arm of said frame, said collection bowl is made of non-toxic material.

9. The portable sink according to claim 6, wherein when the portable sink is in use said collection bowl is adapted to be inserted temporarily at said second opening of said folding support and said first perimetric ridge is adapted to rest temporarily on said folding support, while when the portable sink is not in use said collection bowl is adapted to be engaged with said second removable engagement means.

10. The portable sink according to claim 8, wherein said basin is provided with a second perimetric ridge, substantially C-shaped and in which a second hole is provided that has a same shape as said first hole of said collection bowl, and is provided with a second bottom provided with a drain hole, said basin having a height that is smaller than a height of said collection bowl so that said second bottom is not in contact with said first bottom of said collection bowl, said basin having a length that is slightly greater than a length of said collection bowl and smaller than a height of said second arm of said frame, said basin is made of non-toxic material.

* * * * *